US012172267B2

(12) United States Patent
Bin

(10) Patent No.: US 12,172,267 B2
(45) Date of Patent: Dec. 24, 2024

(54) DETACHABLE GRINDING DISK FOR ELECTRIC GRINDER WITH HIGH ADHESION EFFICIENCY

(71) Applicant: Insun Bin, Jinju-si (KR)

(72) Inventor: Insun Bin, Jinju-si (KR)

( * ) Notice: Subject to any disclaimer, the term of this patent is extended or adjusted under 35 U.S.C. 154(b) by 0 days.

(21) Appl. No.: 17/545,055

(22) Filed: Dec. 8, 2021

(65) Prior Publication Data

US 2022/0388123 A1 Dec. 8, 2022

(30) Foreign Application Priority Data

Jun. 3, 2021 (KR) ..... 10-2021-0072112

(51) Int. Cl.
*B24D 9/08* (2006.01)

(52) U.S. Cl.
CPC ..... *B24D 9/085* (2013.01)

(58) Field of Classification Search
CPC ... B24B 7/186; B24B 2823/00; B24D 11/001; B24D 11/008; B24D 18/0072; B24D 9/00; B24D 9/08; B24D 9/085
USPC ..... 451/259, 359, 420, 458, 539, 548
See application file for complete search history.

(56) References Cited

U.S. PATENT DOCUMENTS 2,597,187 A * 5/1952 Roshong ..... B24D 7/02 451/548
6,530,830 B2 * 3/2003 Rich ..... B24D 13/147 451/550
8,393,941 B2 * 3/2013 Ghinelli ..... B24D 7/04 451/526
10,335,917 B2 * 7/2019 Sato ..... B24B 23/028
2011/0045750 A1 * 2/2011 Stuckenholz ..... B24D 7/04 451/359
2014/0045414 A1 2/2014 Di Mattia
2020/0269389 A1 * 8/2020 Rieth ..... B24D 5/14

FOREIGN PATENT DOCUMENTS

CN 204711782 U 10/2015
EP 2230046 A1 * 9/2010 ..... B24B 23/02
JP 2005-514220 A 5/2005
(Continued)

OTHER PUBLICATIONS

Continuum Mechanics.org, beam bending, 2020, www.continuummechanics.org/beambending.html#. (Year: 2020).*
(Continued)

*Primary Examiner* — Robert F Neibaur
(74) *Attorney, Agent, or Firm* — KORUS Patent, LLC; Seong Il Jeong

(57) ABSTRACT

The present invention discloses a detachable grinding disk for an electric grinder with high adhesion efficiency, the detachable grinding disk comprising: a plate part made of a circular metal plate; a sanding part on which a grinding member is formed so that one side of the plate part has a grinding surface; and a fastening part provided in a form of a through hole at a position of a central axis of the plate part to be easily fastened to the electric grinder, wherein the plate part is formed to have a gradual curvature in such a way that a convex surface of the gradual curvature is formed toward the sanding part, thereby enabling the detachable grinding disk to be attached to the electric grinder closely, elastically, and preventing overturning during high-speed rotation.

3 Claims, 5 Drawing Sheets

(56) References Cited

FOREIGN PATENT DOCUMENTS

| | | | | | |
|---|---|---|---|---|---|
| KR | 10-2006-0024016 | A | | 3/2006 | |
| KR | 10-0955617 | B1 | | 5/2010 | |
| KR | 10-2011-0042846 | A | | 4/2011 | |
| KR | 10-2017-0129455 | A | | 11/2017 | |
| KR | 20170129455 | A | * | 11/2017 | ..... B24D 11/02 |

OTHER PUBLICATIONS

Wikipedia.org, radius of curvature, 2020, web.archive.org/web/20200308014735/https://en.wikipedia.org/wiki/radius_of_curvature (Year: 2020).*
Machine translation of KR-20170129455-A (Year: 2017).*

* cited by examiner

Prior Art

DETACHABLE GRINDING DISK FOR ELECTRIC GRINDER WITH HIGH ADHESION EFFICIENCY

FIELD OF THE INVENTION

The present invention relates to a grinding disk for an electric grinder, and more particularly, to a grinding disk configured to be detachably attached to an electric grinder for table, which is frequently used for various work such as woodworking.

BACKGROUND OF THE INVENTION

In general, as shown in in FIG. 1A, a grinding disk is coupled to an electric grinder, which is to be placed on a table and rotates at high speed along with the electric grinder. These electronic grinders are mainly used for various work including woodworking.

The grinding disk according to the present invention is different from a hand grinder used for double-sided use and cutting purpose, and is used in such a way that one side of a grinding disk is fixed to the disk of an electric grinder through an adhesive.

Specifically, a disk is mounted on an electric grinder, and a grinding paper, or a sand paper, is attached to the disk. In this case, the grinding paper, as a disposable product, can be replaced when the grinding surface of the grinding paper is worn.

For replacement, as shown in FIG. 1B, the grinding paper is forcibly removed, and the surface of the disk with remaining adhesive is polished. Then, a new grinding paper is attached to the disk of an electric grinder through an adhesive.

This replacement process is complicated in that it is difficult for a user to neatly attach a clean grinding paper to an electric grinder at an accurate position.

In addition, even if a user succeeds in attaching a new grinding paper to the disk, since it is likely that the grinding paper is not accurately attached to the center of the disk, vibrations can be generated on the electric grinder while it rotates at high speed, which may cause malfunction of the grinder. It has been reported that safety accidents caused by this malfunction has occurred frequently.

Therefore, there is a need for a solution instead of a current method of attaching a grinding paper to the disk of an electric grinder.

There have been suggestions for a grinding disk in which the disk and the grinding member are integrated into one body, which can be replaceable and reusable for multiple uses.

In this case, since the grinding disk with a simple flat surface may cause difficulties in attaching it to the disk surface of an electric grinder, a proper solution for the surface is also required.

According to prior arts, Korean Patent Publication No. 10-2006-0024016 discloses "A grinding disk and a method for manufacturing the same." However, since the device disclosed herein is produced using high-strength material with high resistance to heat and stress, it is difficult to apply it to actual industry due to low efficiency.

PRIOR ARTS

Patent Document (Patent Document 0001) Korean Patent Publication No. 10-2006-0024016 (2006.03.15)

Technical Problem

Accordingly, the present invention has been devised to solve the problems of the prior art as described above, and an object of the present invention is to provide a grinding disk that can be easily attached to and detached from an electric grinder.

In addition, another object of the present invention is to provide a grinding disk capable of preventing overturning phenomenon when the grinding disk is fastened to an electric grinder.

Another object of the present invention is to provide a method for manufacturing a grinding disk that can be closely attached to an electric grinder when the grinding disk is fastened to the electric grinder.

The problems to be solved by the present invention are not limited to the problems mentioned above, and other problems to be solved by the present invention not mentioned herein can be clearly understood by one skilled in the art.

SUMMARY OF THE INVENTION

To achieve the object mentioned above, the present invention provides a detachable grinding disk for an electric grinder with high adhesion efficiency, the detachable grinding disk comprising: a plate part made of a circular metal plate; a sanding part on which a grinding member is formed so that one side of the plate part has a grinding surface; and a fastening part provided in a form of a through hole at a position of a central axis of the plate part to be easily fastened to the electric grinder, wherein the plate part is formed to have a gradual curvature in such a way that a convex surface of the gradual curvature is formed toward the sanding part, thereby enabling the detachable grinding disk to be attached to the electric grinder closely, elastically.

Advantageous Effects

Accordingly, a detachable grinding disk for an electric grinder with high adhesion efficiency according to the present invention can be easily attached to and detached from the electric grinder, thereby enabling convenient reuse.

In addition, a detachable grinding disk for an electric grinder of the present invention can be adhered to the entire surface of an electric grinder when the grinding disk is fastened to the electric grinder.

In addition, a detachable grinding disk for an electric grinder of the present invention can prevent overturning phenomenon during high-speed rotation after fastening the grinding disk to the electric grinder.

BRIEF DESCRIPTION OF THE DRAWINGS

FIG. 2, (b) of FIG. 2, is a front view of a detachable grinding disk for an electric grinder with high adhesion efficiency according to the present invention.

DETAILED DESCRIPTION EMBODIMENTS OF THE INVENTIONS

Specific details including the problems to be solved, the means for solving the problems, and the technical effects for the present invention as described above are included in the embodiments and drawings to be described below. Advantages and features of the present invention, and methods of achieving them will become apparent with reference to the embodiments described below in detail in conjunction with the accompanying drawings.

Figure 1A:
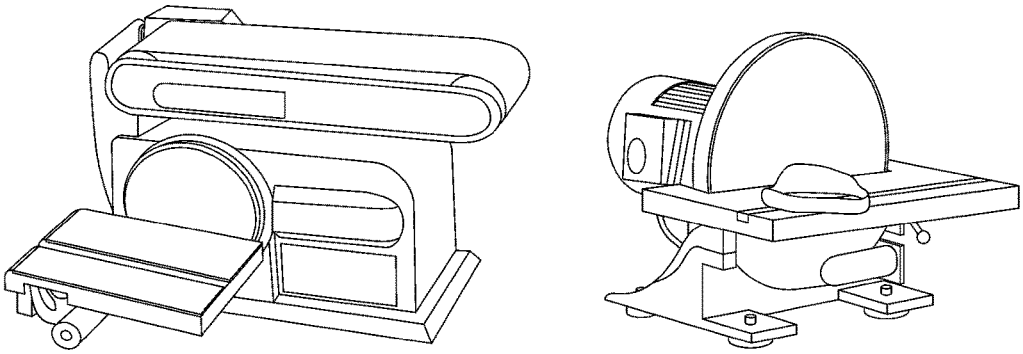
FIG. 1A illustrates several types of conventional electric grinders.
Figure 1B:
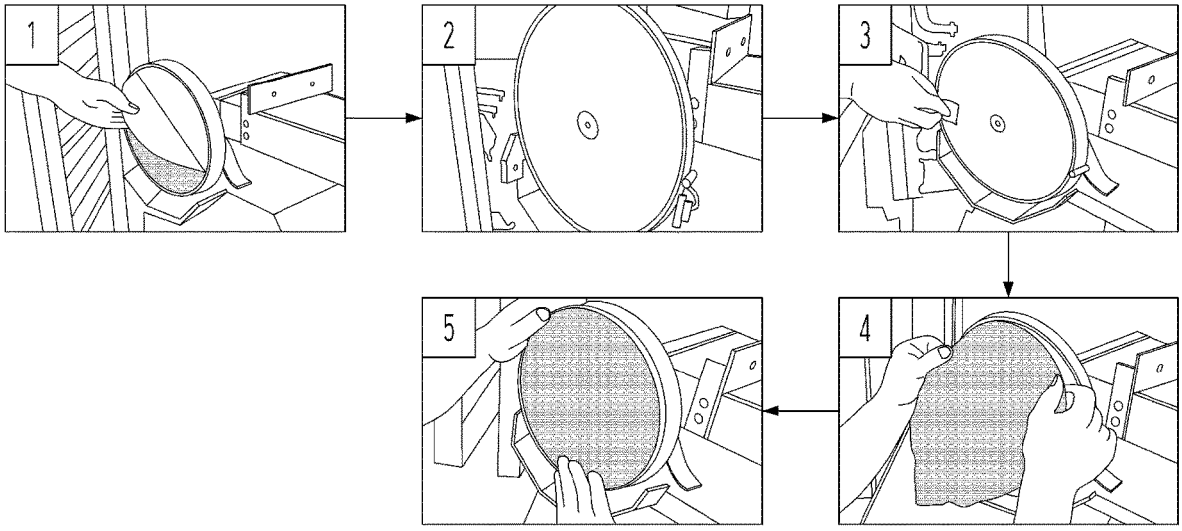
Prior Art FIG. 1B
FIG. 1B is images sequentially illustrating a process of replacing a grinding paper on a disk of an electric grinder using an adhesive according to a conventional method.
Figure 2:
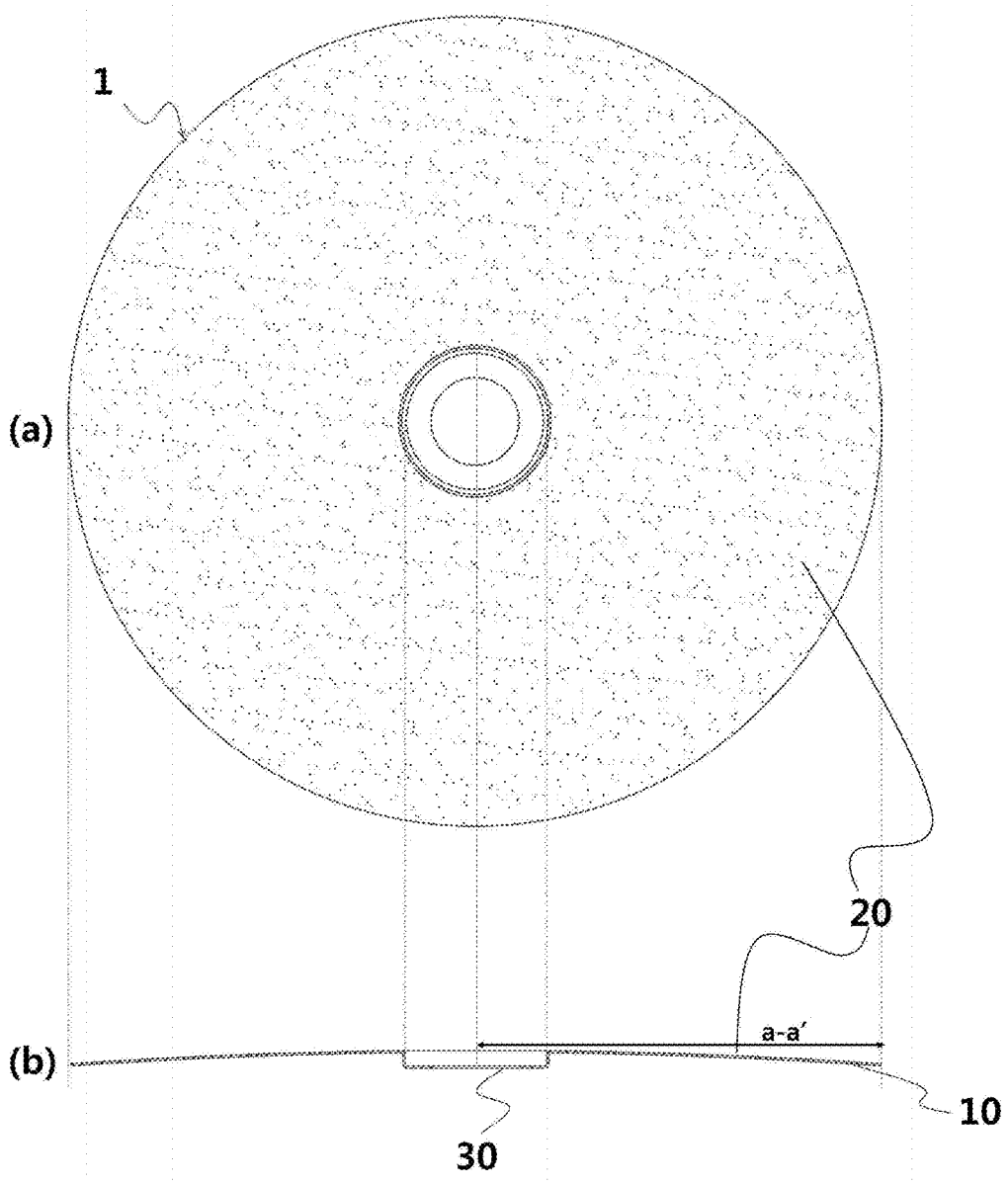
FIG. 2, (a) of FIG. 2, is a top view of a detachable grinding disk for an electric grinder with high adhesion efficiency according to the present invention.

As shown in FIG. 2, a detachable grinding disk 1 for an electric grinder P with high adhesion efficiency according to the present invention comprises: a plate part 10 made of a circular metal plate; a sanding part 20 on which the grinding member is formed so that one side of the plate part 10 has a grinding surface; and a fastening part 30 provided in a form of a through hole at the position of the central axis of the plate part 10 to be easily fastened to the electric grinder P. In this case, the plate part 10 is formed to have a gradual curvature K in such a way that a convex surface of the gradual curvature K is formed toward the sanding part 20, thereby enabling the detachable grinding disk 1 to be attached to the electric grinder closely and elastically.

Specifically, first, the plate part 10 is provided with a circular metal plate.

It will be apparent that the plate part 10 is configured to have a shape and size that can be fastened to the electric grinder P without impairing grinding function, and to have a thickness that is easy to fasten to the electric grinder.

In this instance, the plate part 10 is formed to have a slight and gradual curvature surface in such a way that the convex surface of the curvature surface is formed toward the sanding part 20 on which the grinding surface is formed.

This structure is to enable the plate part 10 to be securely fastened to the electric grinder P even during high-speed rotation for a long period of time.

Figure 3A:
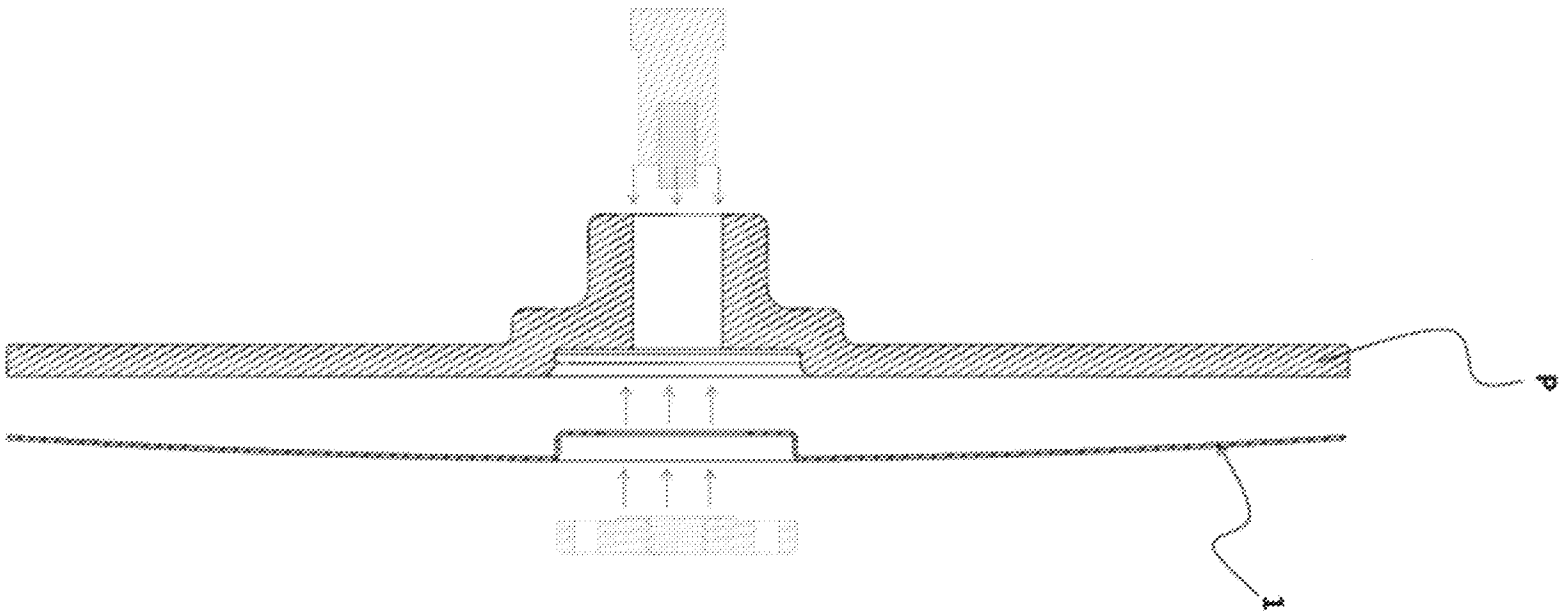
FIG. 3A is a drawing illustrating a detachable grinding disk and an electric grinder before fastening the grinding disk to an electric grinder according to the present invention.
Figure 3B:
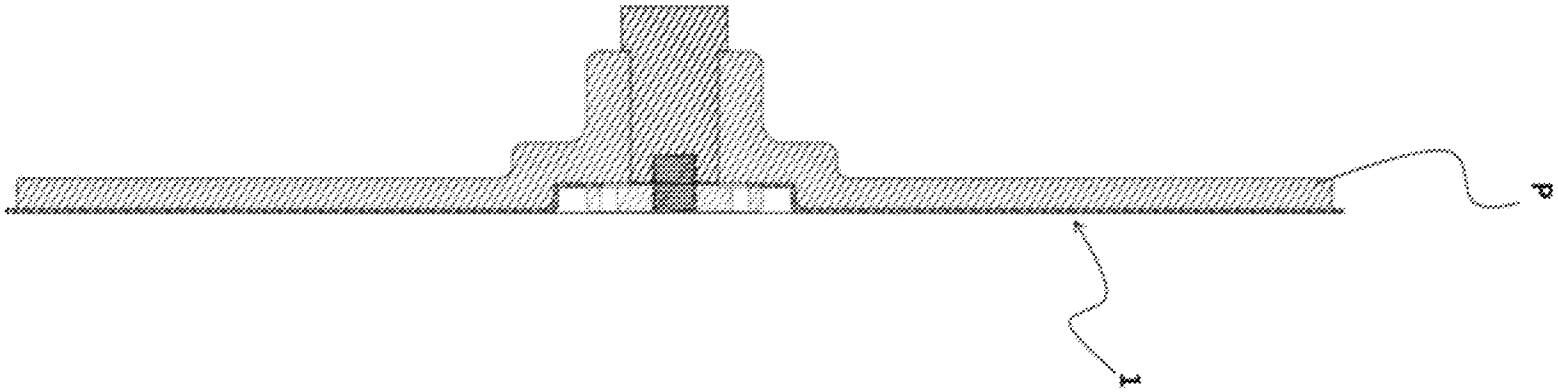
FIG. 3B is a drawing illustrating a detachable grinding disk closely attached to an electric grinder after fastening the grinding disk to the electric grinder according to the present invention.

As shown in of FIG. 3A, the plate part 10 is configured in a shape in which the convex surface of the curvature surface is formed on the sanding part 20, and thus, as shown in FIG. 3B, the plate part 10 can be elastically, tightly coupled and fastened to the electric grinder P.

In this case, it will be apparent that the plate part 10 with the curved surface must be a certain structure made of elastic material that can be attached to the electric grinder P closely and elastically when being fastened, as shown in FIG. 3B, and can be restored to the same shape as that shown in FIG. 3A when being separated from the electric grinder P.

In case of a conventional grinding disk with a simple flat surface, the grinding disk is easily deformed due to heat, centrifugal force, and continual local pressure in a grinding area while performing grinding with high-speed rotation for a long period of time, and thus, the grinding disk is overturned, reversed, or bent.

Therefore, to prevent deformation of a grinding disk, it is preferable that the plate part 10 has a curvature surface.

In this case, when the convex surface is formed toward the direction in which the grinding surface of the plate part 10 is formed, the curvature K of the convex surface should be a certain range. If the curvature K of the convex surface is not properly formed, the grinding disk may become overturned or reversed, or be not closely attached to the electric grinder over the entire surface, and thus, may cause an uneven grinding surface.

Specifically, if the curvature K of the convex surface has constant level over the entire surface, and the value of the curvature K is excessively high, the grinding disk becomes overturned or reversed during the fastening process.

In addition, if the curvature K of the convex surface has constant level over the entire surface, and the value of the curvature K is excessively low, a space may be formed between grinding disk and the electric grinder P at the center due to an elastic force, and thus, the grinding disk cannot be closely attached to the electric grinder P.

Therefore, it is preferable that the plate part 10 is configured to have a curvature K that decreases gradually and continuously as the curvature K goes toward the outer circumference and converges to 0 at the outer circumference.

Figure 4:
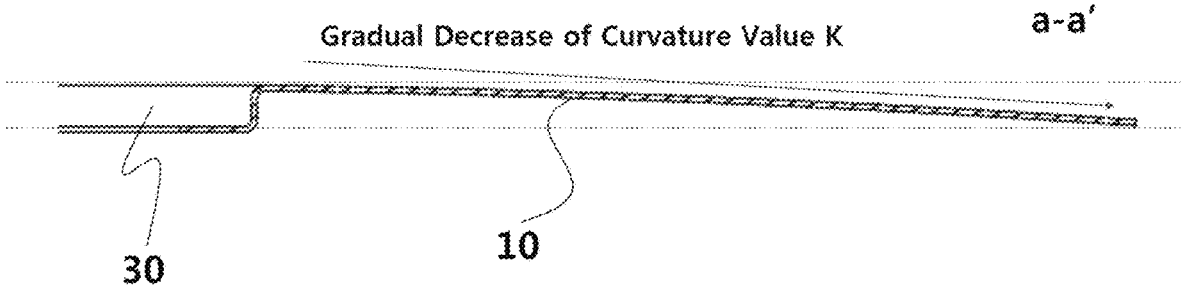
FIG. 4 is a cross-sectional view of a-a' section of the detachable grinding disk shown in (b) of FIG. 2 according to the present invention.
Figure 5:
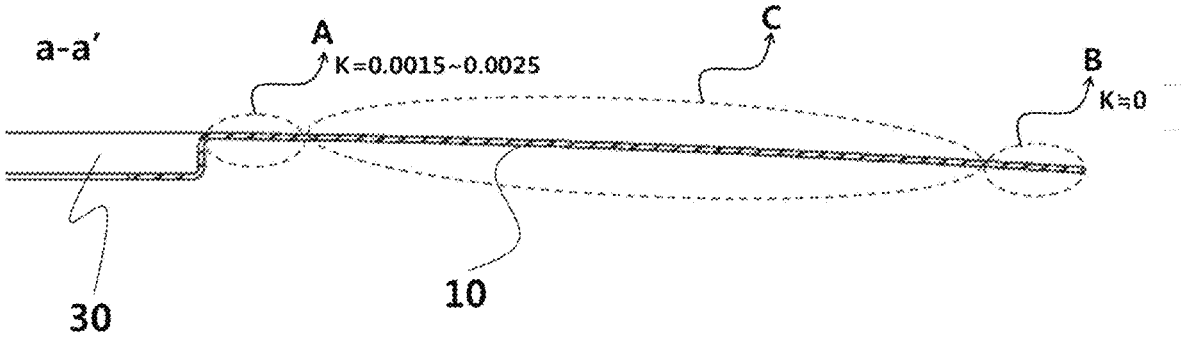
FIG. 5 is a cross-sectional view of the a-a' section of the detachable grinding disk shown in (b) of FIG. 2 according to the present invention, showing the degree of curvature formed for each part of the a-a' section.

Specifically, as shown in FIG. 4, the plate part 10 is formed in a structure in which the value of the curvature K, in a cross-section view, decreases as it goes toward the outer circumference, and as shown in FIG. 5, the value of the curvature K near the central axis portion A of the plate part 10 is in the range of 0.0015 to 0.0025.

It is desirable that the value of the curvature near the outer circumference portion B of the plate part 10 converges to 0 as a flat plane, and that the value of the curvature K between the central axis portion A and the outer circumference portion B of the plate portion 10 decreases gradually and continuously as the curvature K goes toward the outer circumference.

As described above, the curvature K reduced as it goes toward the outer circumference, can solve the problems caused by incomplete contact between the electric grinder P and a grinding disk that has a convex surface with constant curvatures.

According to the present invention, if the curvature K of the convex surface gradually decreases as it goes toward the outer circumference portion B of the plate part 10, it is easy to form a stable contact between the electric grinder P and the grinding disk 1 without overturning issues.

There may be differences in accurate values depending on mechanical properties such as elasticity, bending strength, and brittleness of the material used for forming the plate part 10. However, the structure itself can enable to form a complete contact between the electric grinder P and the grinding disk 1, and can maintain its shape during high-speed rotation.

Next, the grinding member is formed on the sanding part 20 so that a grinding surface can be formed on one side of the plate part 10.

In this case, the grinding member may be configured in any shape if the material of the grinding member is capable of grinding metal and wood.

In addition, the sanding part 20 may be provided in any shape if the material of the grinding member can be stably formed thereon.

Furthermore, the sanding part 20 may be configured to be integrated with the plate part 10 through a ceramic material, which is mixed in a manufacturing process of the plate part 10.

The plate part 10 and the sanding part 20 may be formed separately and configured to be detachably attached to each other. More preferably, the plate part 10 and the sanding part 20 are integrally formed and manufactured as a single body.

In this case, rather than attaching the grinding paper to the electric grinder P and forcibly detaching the paper from the grinder P, the plate part 10 and the sanding part 20 may be integrated into one body by using a coupling element such as bolting, thereby improving user convenience in both processes of attaching and detaching.

If the grinding surface of the sanding part 20 maintains reusable condition, additional reuse is also possible.

Next, the fastening part 30 is provided in a form of a through hole at the position of the central axis of the plate part 10 to be easily fastened to the electric grinder P.

The fastening part 30 may be configured in any shape if it can be easily fastened to the rotary shaft of the electric grinder P.

As described above, one skilled in the art to which the present invention pertains will understand that the above-described technical configuration of the present invention may be implemented in other specific forms without changing the technical spirit or essential characteristics of the present invention.

Therefore, the embodiments described above should be understood as illustrative and not restrictive in all respects, and the scope of the present invention is indicated by the appended claims rather than the detailed description above. The meaning and scope of the claims and their changes or modifications derived from the equivalents should be construed as being included in the scope of the present invention.

What is claimed is:

1. A detachable grinding disk for an electric grinder, the detachable grinding disk comprising:

a plate part made of a circular metal plate;

a sanding part on which a grinding member is formed, the sanding part being disposed on one side of the plate part; and a fastening part provided in a form of a through hole at a position of a central axis of the plate part to be fastened to the electric grinder, wherein the plate part is formed to have a varying curvature in such a way that a convex surface of the varying curvature is formed toward the sanding part, the plate part being configured to have the varying curvature that decreases continuously as the curvature goes from a portion of the central axis to an outer circumference of the plate part, in a cross-sectional view, and to have an elasticity such that the plate part is transshaped to completely contact with the electric grinder when being fastened to the electric grinder and is restored to an original shape when being separated from the electric grinder.

2. The detachable grinding disk of claim 1, wherein a maximum value of the curvature near the portion of the central axis is in the range of 0.0015 to 0.0025, and a value of the curvature of the outer circumference of the plate part converges to 0.

3. The detachable grinding disk of claim 1, wherein the plate part and the sanding part are integrally formed as one body.

* * * * *